US011162711B2

(12) United States Patent
Zeitz

(10) Patent No.: US 11,162,711 B2
(45) Date of Patent: Nov. 2, 2021

(54) TANKLESS MOLDED WATER HEATER

(71) Applicant: Van Zeitz, Los Alamitos, CA (US)

(72) Inventor: Van Zeitz, Los Alamitos, CA (US)

( * ) Notice: Subject to any disclaimer, the term of this patent is extended or adjusted under 35 U.S.C. 154(b) by 264 days.

(21) Appl. No.: 16/238,756

(22) Filed: Jan. 3, 2019

(65) Prior Publication Data

US 2020/0217560 A1 Jul. 9, 2020

(51) Int. Cl.

| | |
|---|---|
| ***F24H 9/20*** | (2006.01) |
| ***F24H 1/10*** | (2006.01) |
| ***F24H 9/02*** | (2006.01) |
| ***F24H 9/14*** | (2006.01) |
| ***F24H 9/00*** | (2006.01) |

(52) U.S. Cl.

CPC ..... *F24H 9/2028* (2013.01); *F24H 1/103* (2013.01); *F24H 9/0015* (2013.01); *F24H 9/02* (2013.01); *F24H 9/146* (2013.01); *F24H 2250/02* (2013.01)

(58) Field of Classification Search

CPC ..... F24H 9/2028

See application file for complete search history.

(56) References Cited

U.S. PATENT DOCUMENTS

| | | | | |
|---|---|---|---|---|
| 5,408,578 | A * | 4/1995 | Bolivar | F24H 1/102 219/481 |
| 6,246,831 | B1 * | 6/2001 | Seitz | F24H 9/2021 219/483 |
| 6,389,226 | B1 * | 5/2002 | Neale | F24H 1/102 392/485 |
| 6,701,069 | B1 * | 3/2004 | Cezayirli | F24H 1/102 392/490 |
| 7,779,790 | B2 * | 8/2010 | Fabrizio | F24H 9/2028 122/40 |
| 9,341,391 | B2 * | 5/2016 | Stebbins | F24D 17/0026 |
| 9,574,792 | B2 * | 2/2017 | Lutz, II | H05B 3/82 |
| 9,709,299 | B2 * | 7/2017 | Jansen | F24H 9/0021 |
| 2008/0285964 | A1 * | 11/2008 | Sullivan | H05B 3/78 392/485 |
| 2011/0069943 | A1 * | 3/2011 | Luppold | B60H 1/2221 392/488 |

* cited by examiner

*Primary Examiner* — Nathaniel Herzfeld

(74) *Attorney, Agent, or Firm* — Scott R. Hansen; Viking IP Law

(57) ABSTRACT

A tankless hot water heater has a molded body having an inlet and an outlet. The water heater has a clamshell design such that upper and lower portions are removably attached to one another. A channel extends from the inlet to the outlet. Heating elements extend through at least a portion of the channel and are configured to heat water flowing through the channel. Sensors are configured to measure temperature of water flowing through the channel prior to coming into contact with the heating element. Sensors measure flow rates, temperatures, presence of air, and/or other factors. A controller adjusts power supplied to heating elements using data from sensors.

20 Claims, 10 Drawing Sheets

TANKLESS MOLDED WATER HEATER

BACKGROUND

Traditional water heaters produce heated water and store it in an insulated tank until the hot water is needed. As the tank can only keep the water heated for a limited time, unused hot water must periodically be reheated so that it is ready for use.

Tankless water heaters have been developed to eliminate the need for a storage tank. Water is heated on demand. Numerous designs of tankless water heaters have been introduced. Many of these designs are somewhat complex, including tubing, couplings, and other separate parts.

What is needed is a more simple tankless water heater design with fewer parts that are conveniently accessible.

BRIEF SUMMARY OF THE INVENTION

In one embodiment of the invention, a tankless hot water heater has a molded body having an inlet and an outlet that are in fluid communication with one another. A channel extends from the inlet to the outlet. At least one heating element extends through the channel to heat water. An optional sensor may be configured to measure the temperature of water flowing through the channel prior to coming into contact with the heating element. The heater has at least one flow sensor configured to measure flow and/or flow rate of water prior to coming into contact with the heating element. At least one sensor is configured to measure temperature of water flowing through the channel after coming into contact with the heating element(s).

The heater has a controller, which may include a microprocessor, adapted to control heat generated by the heating element based on input from the temperature and flow sensors. Also, the molded body is a clamshell design having an upper portion and a lower portion, with the upper and lower portions removably secured together.

The tankless hot water heater as described above may include various optional features, either alone or in combination. The channel may include at least two straight portions interconnected by a curved portion, with first and second heating elements extending through first and second straight portions, respectively. The controller may independently control heat generated by the first and second heating elements. The channel may include grooves molded in the water channel adapted to create turbulent flow. The grooves may be twisted, and extend into the wall. As an alternative, twisted protrusions may extend from the wall. The channel may have both portions with grooves and smooth portions to achieve a desired flow profile.

In the clamshell design, a portion of the channel may be molded into each of the upper and lower portions of the clamshell, wherein the channel becomes closed when the upper and lower portions are secured together. The water heater may have a display unit for displaying water temperature and/or other information such as time of day, flow rate, inflow & outflow temperature, and other data as desired. The system may include an input device for receiving desired temperature settings from a user. The input may be manual, electronic, via an app on a mobile phone, or any other manner in which data can be input. The heater may optionally be connected to a network, such as a local network and/or the Internet.

Continuing with optional features that may be incorporated into the tankless water heater, either alone or in combination with other optional features, the water heater may have a pressure relief valve. The controller may include a microprocessor and memory, and may be programmed to use an algorithm, tables, and data as suitable for controlling the heating elements.

The heater element, such as a coil for example, may be in direct contact water. The channel may include a series of generally straight portions interconnected with curved portions, the straight and curved portions being molded into the body. In this configuration, heating elements may extend in respective generally straight portions of the channel.

The body may be injection molded, or otherwise molded. Typically, the body is a molded thermoset polymer suitable for use with the hot water the heater generates.

According to another embodiment of the present invention, a tankless, on-demand hot water heater has an injection molded body with a water inlet and a water outlet that are in fluid communication with one another. A channel extends from the inlet to the outlet, the channel having at least two molded straight portions interconnected by a molded curved portion. Heating elements extend through respective straight portions. Sensors are configured to measure temperature and flow of water entering the heater. One or more sensors are positioned to measure temperature of water exiting the heater. Sensors of various types may be employed at various positions within the heater. For instance, sensors to detect the presence of air in the channel may be employed.

The system includes a controller comprising a microprocessor adapted to control heat generated by the heating elements independently from one another, based on input from temperature and flow sensors. The molded body may be a design having an upper portion and a lower portion that are separable from one another, with the upper and lower portions removably secured together. The channels may include twisted grooves molded into the water channel and adapted to create turbulent flow.

According to another embodiment of the invention, a tankless hot water heater has a molded body having an inlet and an outlet that are in fluid communication with one another via a channel. At least one heating element extends through at least a portion of the channel and is configured to heat water flowing through the channel. At least one sensor is configured to measure at least one of water temperature and water flow at a location in the channel. A controller is adapted to control heat generated by the at least one heating element based on input from the at least one sensor. The molded body has an upper portion and a lower portion, with an upper portion of the channel molded into the upper portion of the molded body and a lower portion of the channel molded into the lower portion of the molded body, the upper and lower portions of the body being removably secured together.

The foregoing and other objects, features, and advantages of the invention will become more apparent from the following detailed description, which proceeds with reference to the accompanying figures.

DETAILED DESCRIPTION OF A PREFERRED EMBODIMENT

Figure 1:
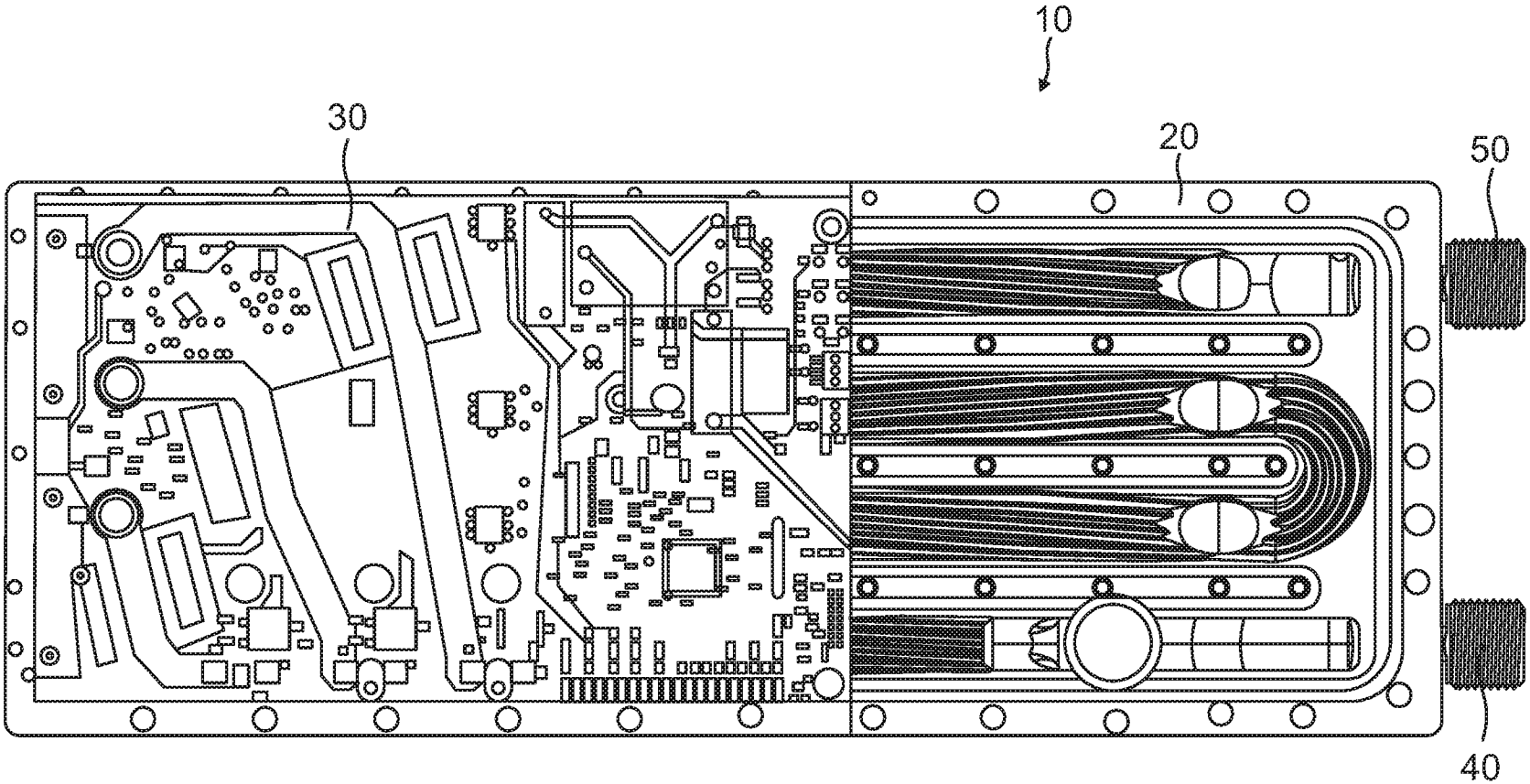
FIG. 1 is a top view of an assembled tankless water heater with the enclosure cover and lid assembly removed.

Considering one embodiment of the present invention in general terms, the invention includes an injection molded tankless on-demand water heater. The heater has a clamshell design that enables various water passage shapes, sizes, and contours, all incorporated into one two-piece heat-exchanger unit that does not utilize multiple separate tubes and/or manifolds. This embodiment includes a combination of smooth bore and twisting grooves which are molded into the water passages to enable laminar flow where desired, or turbulent flow where desired.

The heater includes multiple heating elements made of nickel-chromium wire with which the water comes in direct contact with the heating elements. Each of the heating elements may be individually controlled such that failure of one heating element may affect system performance but has no impact on the individual performance of the remaining heating elements.

This embodiment may have further features, such as a pressure relief valve and/or a high temperature cut-out switch.

The heater includes a control system. In one embodiment, the control system includes a paddle-wheel style flow meter, with multiple imbedded magnets, and which includes a moving device allowing for variable flow increased low-flow sensitivity and also high flow rates when device moves. A Hall Effect sensor detects pulses per second from the paddle-wheel magnets. Alternatively, other flow sensors that detect flow and/or flow rate may be used.

The control system may also include temperature sensors at the outflow and/or inflow regions of the heater. The control system may also include sensing when there is air in the system. For example, capacitance water sensing may be employed and the control system adapted to prevent energizing the heating elements when air is detected in the water passages.

The control system may include a printed circuit board that has a microprocessor. As the unit may be used with a variety of voltage inputs, in one embodiment the power supply is adapted to receive input at a variety voltages, such as between 120 VAC to 300 VAC, for example. The control system may also have automatic voltage sensing to the heating elements and used to control system performance. Similarly, it may have automatic current sensing to the heating elements and used to control system performance.

The system may have certain user-control features. For instance, it may have a user selectable "Soft Start" to avoid dimming or flickering of household lighting. It may have user selectable power-draw from 100% down to 50% power (Amps) in 1% increments. In one embodiment, the system has 10 color LEDs providing service technicians with 10 system status indications.

The system may also have digital communication links that enables balancing of work load between heat exchangers when more than one heat exchanger is used in series. In some embodiments, the heater has a digital LCD display that provides the user system status messages, error codes per unit, and/or menu items. In one embodiment, multiple error codes are generated to allow faults to be identified down to the component level.

Numerous other options and features may be incorporated into the system. For instance, the system and/or display may have multi-color backlighting to enhance viewing and to draw attention to status messaging. Set-Point temperature and actual output temperature may be displayed simultaneously, for example. The display may also display such information as fluid temperature at various locations within the heater, paddle wheel pulses per second converted to gallons per minute (GPM), hours of operation, date, time of day, temperature history, energy use, water used over a chosen period of time, and any other information that may be of interest to a user and/or support professionals.

Turning now to one specific embodiment of the invention in FIG. 1, a tankless electric water heater 10 (with the cover removed for clarity) has an injection-molded, clamshell body 20. The injection-molded body is typically formed from a strong, durable, heat-resistant polymer that is suitable for long-term use with electric heating elements and high-temperature water flowing through channels therein. Other forms of molding known in the art may alternatively be employed, or other manufacturing methods such as 3-D printing.

A circuit board 30 is secured to one side of the clamshell body 20. The circuit board includes a microprocessor. The circuit board 30 receives signals from sensors such as flow sensors, temperature sensors, air sensors and/or other sensors. Based on these inputs, the microprocessor controls aspects of the heater, such as the power supplied to heating elements within the body 20. The microprocessor is suitably programmed with code, can access tables, data and the like to execute its functions.

Water flows into the heater at inflow fitting 40. The water then flows through a serpentine channel within the molded body, contacting heating elements as it flows, then exits through outflow fitting 50.

Figure 2:
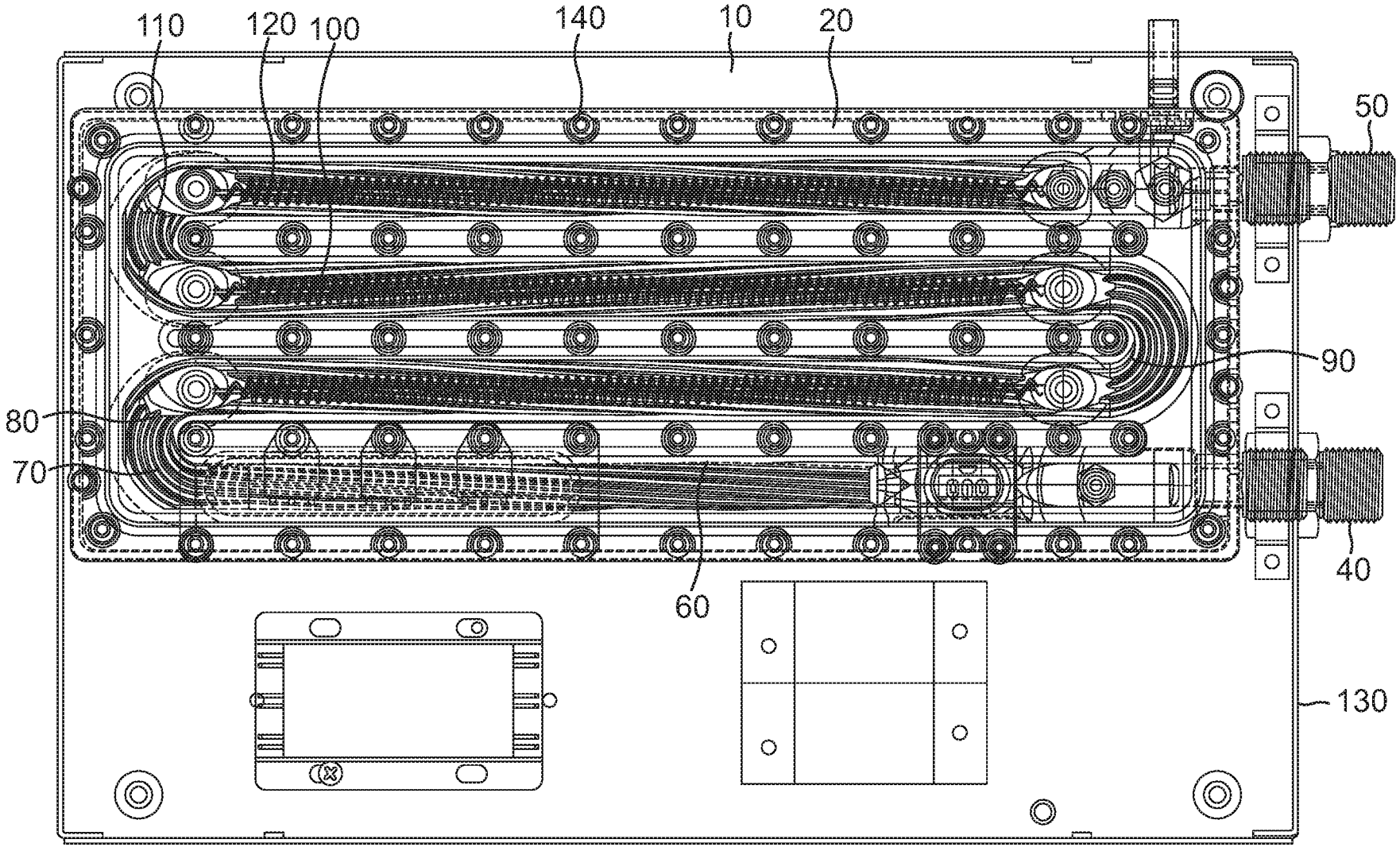
FIG. 2 is a top view of the tankless water heater within a metal base, with the circuit board and lid removed for clarity.

FIG. 2 illustrates the body 20 with the cover and circuit board removed to view the interior of the body. The body is held within a metal base 130, which may alternatively be made of other materials known in the art. As noted, the heater has a water inlet 40 and a water outlet 50. A series of channels runs through the interior of the body, through which water flowing through the body flows. The channels comprise straight portions 60, 80, 100, 120 and integral curved portions 70, 90, 110. Heating elements extend through straight portions. In the embodiment of FIG. 2, there are three heating coils, extending through straight channel portions 80, 100, 120, respectively. The upper and lower portions of the clamshell design are held together with fasteners such as screw or nuts at numerous locations, one of which is illustrated as reference numeral 140.

Figure 3:
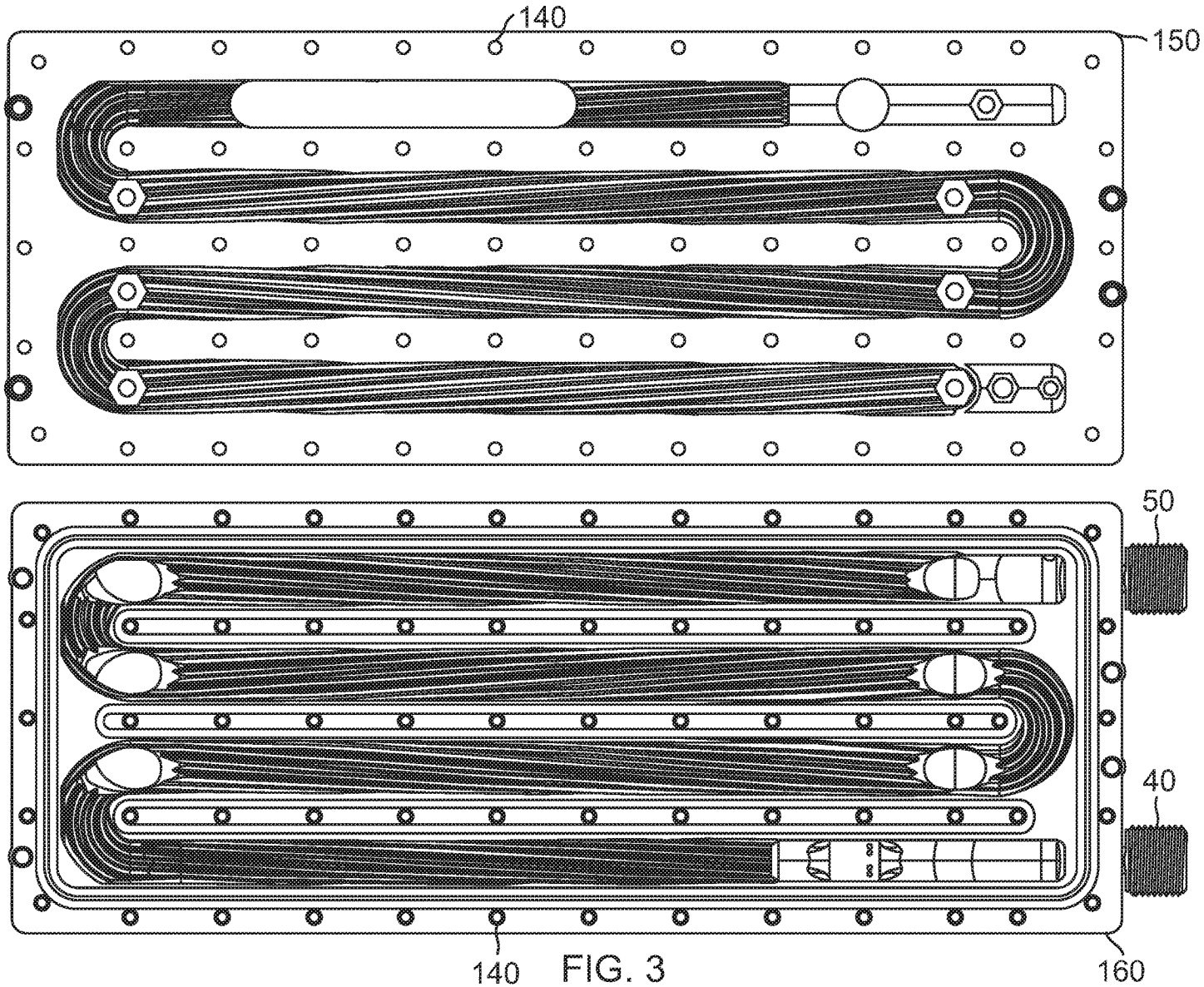
FIG. 3 is the tankless water heater of FIG. 1 with the upper and lower portions of the molded body separated.

FIG. 3 illustrates the interior of the top 150 and bottom 160 of the heater, as they appear when uncoupled and with the molded channel facing upwardly. As can be seen, this embodiment includes a combination of smooth bore and twisting grooves 200 (FIG. 4) which are molded into the water passages to enable laminar flow where desired, or turbulent flow where desired. As seen in FIG. 3, the top and bottom portions include complementary portions of water channels and twisting grooves. The heating elements, which are typically metal coils, extend through straight channel portions 80, 100, 120 on the top portion 150 of the heater, as seen in FIG. 2. The ends of each coil are secured at screw heads (seen on FIG. 2 but not numbered).

Figure 4:
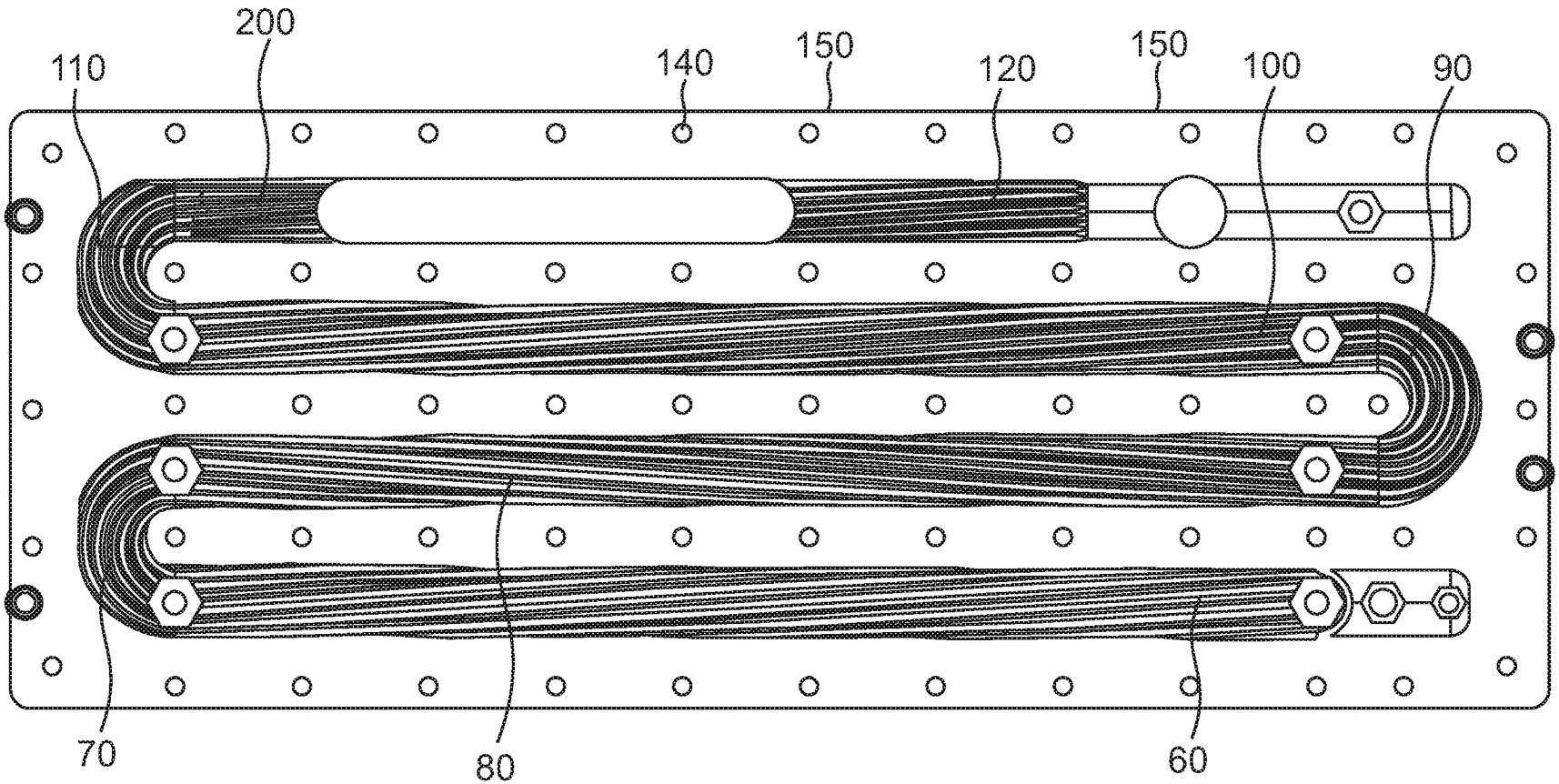
FIG. 4 illustrates the upper portion of the water heater of FIG. 1.
Figure 5:
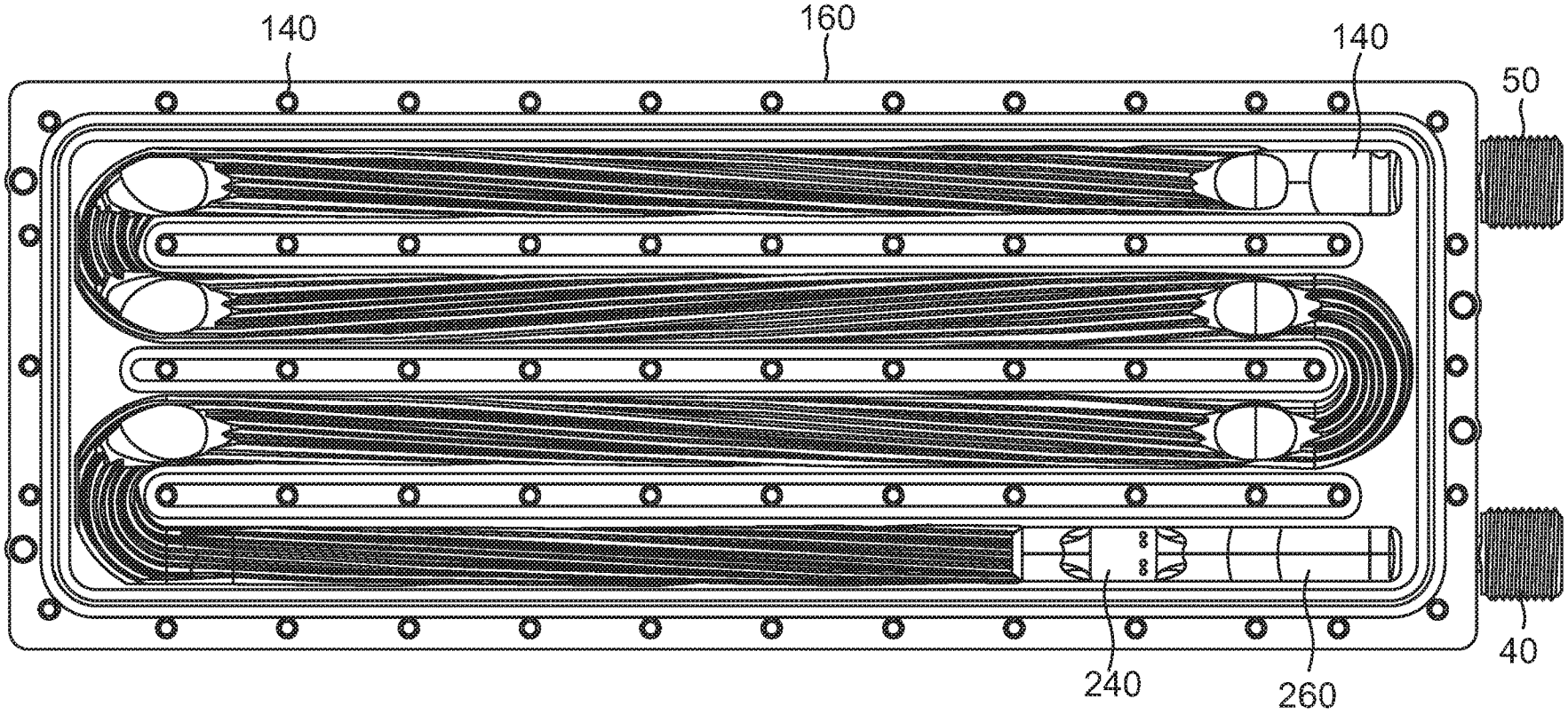
FIG. 5 illustrates the lower portion of the water heater of FIG. 1.

FIGS. 4 and 5 illustrate the top and bottom portions of the heater, respectively, in greater detail. Referring to FIG. 5, the bottom portion 160 also includes temperature sensors 240 and 250 at the inflow and outflow portions, respectively. There is also a flow sensor 260 at the inflow location. The various sensors are in communication with the circuit board 30 which, as noted, controls power supplied to each of the heating element coils 80, 100, 120 via a microprocessor.

Typically the top and bottom portions of the clamshell are secured together with screws, bolts and/or other fasteners suitable for tightly securing the two portions together such that water is contained within the unit and does not leak. Waterproof rings, seals, and the like may be employed as desired to further prevent water from leaking from the unit.

Portions of the channel may be made deeper than others. For example, the channel may be deeper at the inlet and outlets. This accommodates inlet and outlet ports that have a greater diameter than other portions of the channel. That is, most of the channel through which water flows may have a narrower diameter while the channel at the inlet and outlet portions may have a wider diameter, tapering or otherwise narrowing from the wider diameter to the narrower diameter. The dimensions of the channel within the body may vary at certain points, either as a result of molding considerations or to alter the profile of the water flow.

Figure 6:
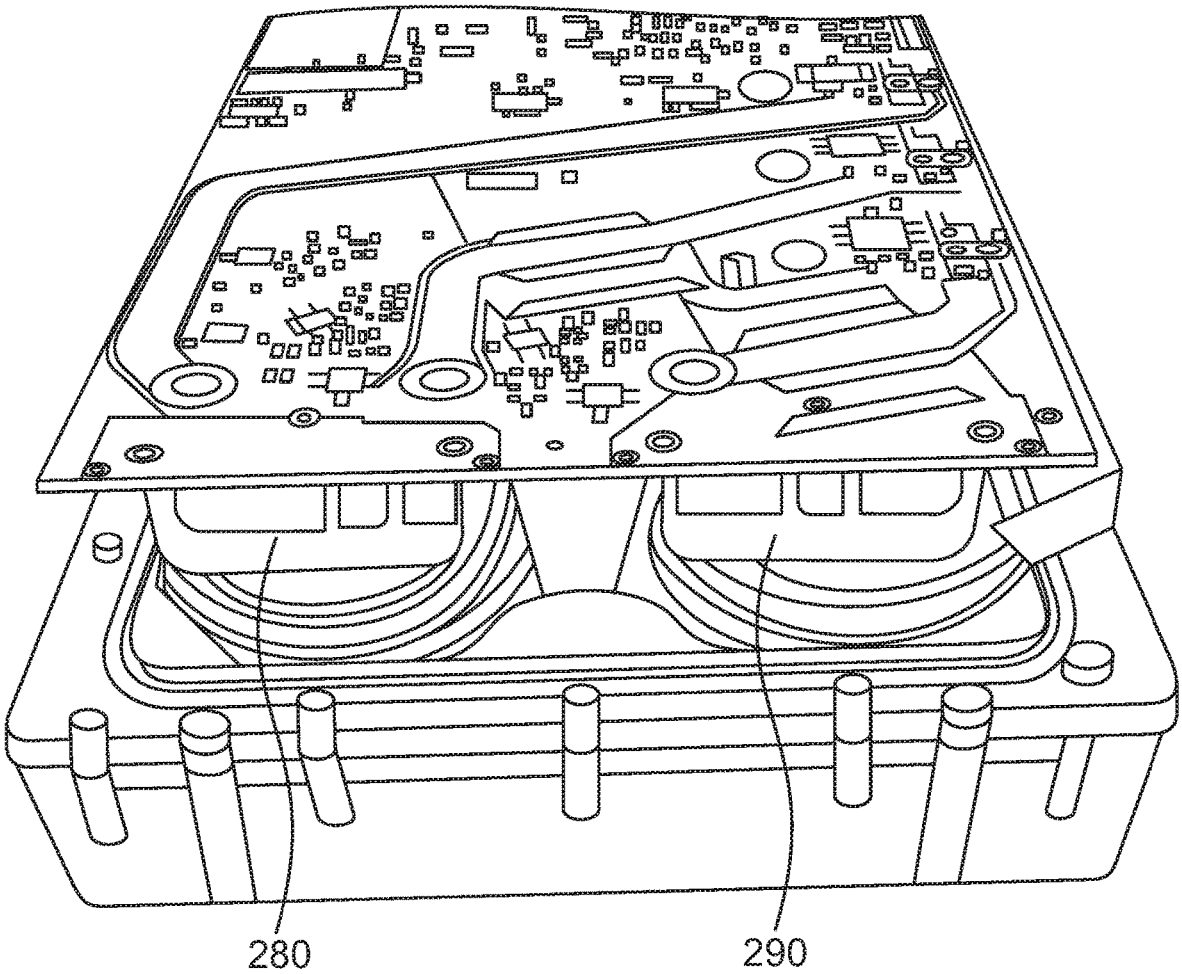
FIG. 6 illustrates an end view of the water heater of FIG. 1 with the circuit board in place.

Considering FIG. 6, capacitance plates such as 280 and 290 may be provided to detect when air is present in the channel. Damage to the unit can be caused by the presence of air in the system because no water is present to cool the heating elements(s). Signals from the capacitance plates may be transmitted to the microprocessor, which controls the application of power to the heating element(s) in response to the presence of air.

Figure 7:
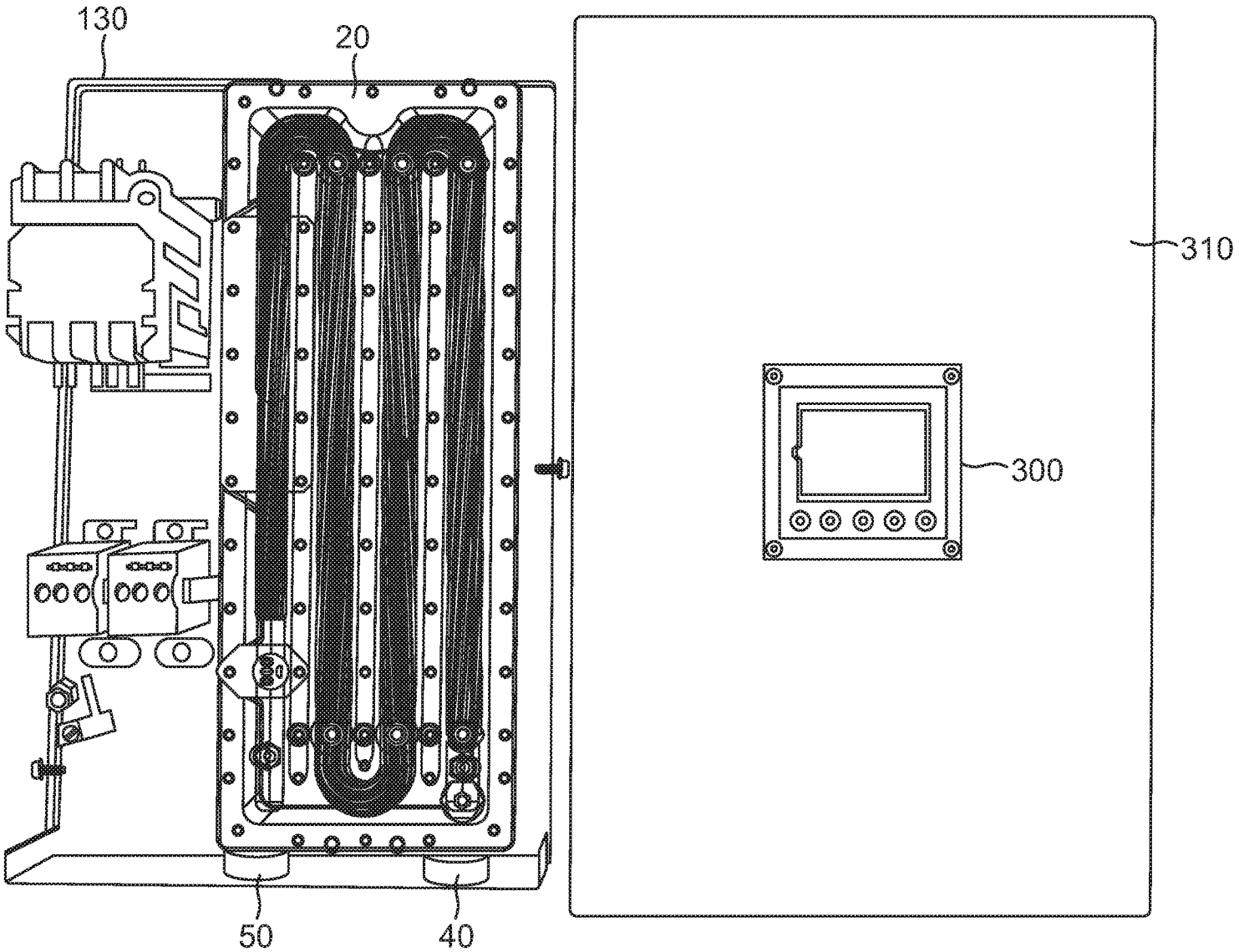
FIG. 7 illustrates an assembly of a metal base, water heater and, to the side, a top cover with a screen on the cover for displaying information, with the circuit board not shown for clarity.
Figure 8A:
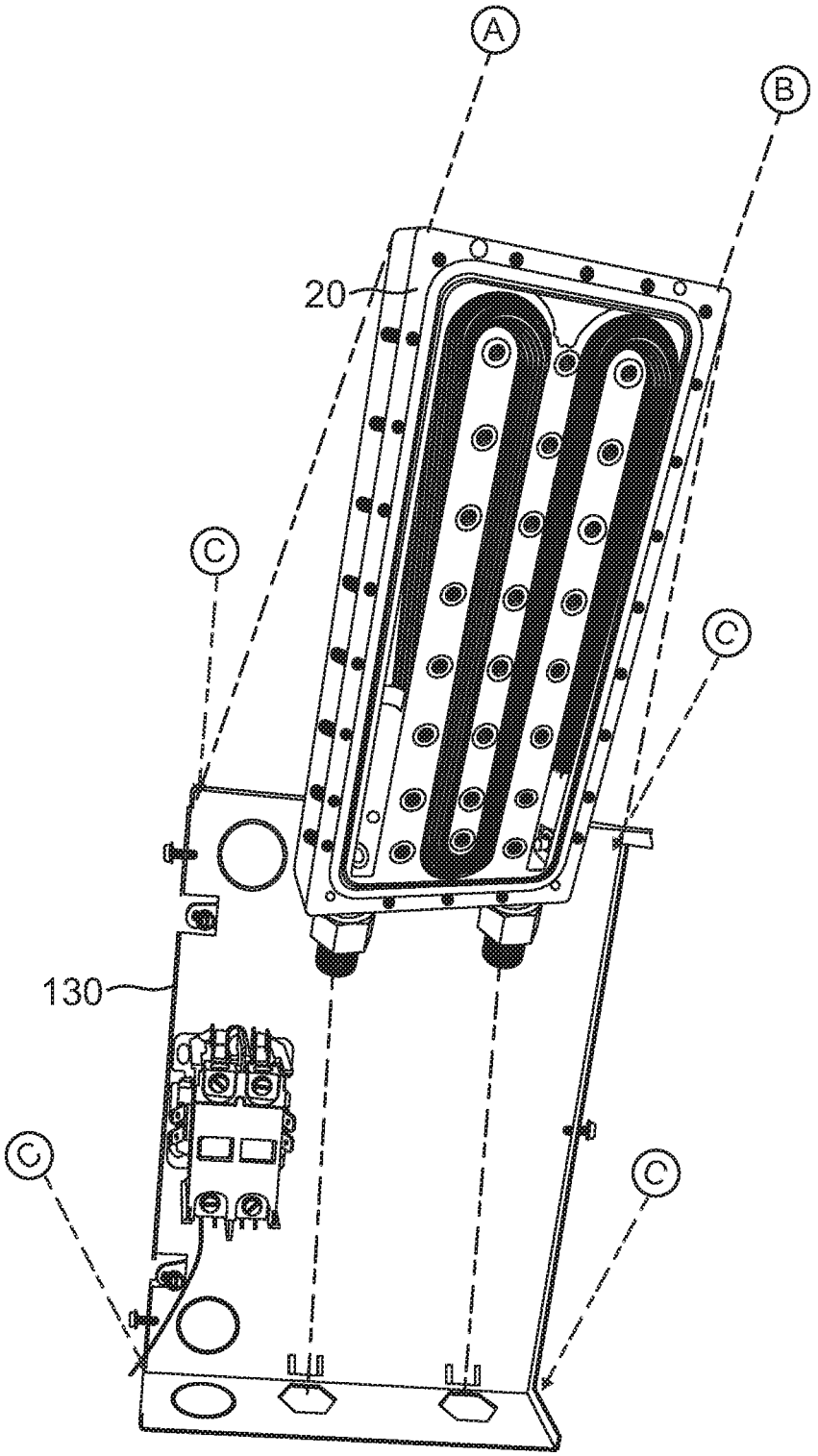
FIG. 8A-C illustrate one approach to assembling components of an embodiment of the invention, such as a metal base, a water heater, circuit board, and a cover with a display screen.
Figure 8B:
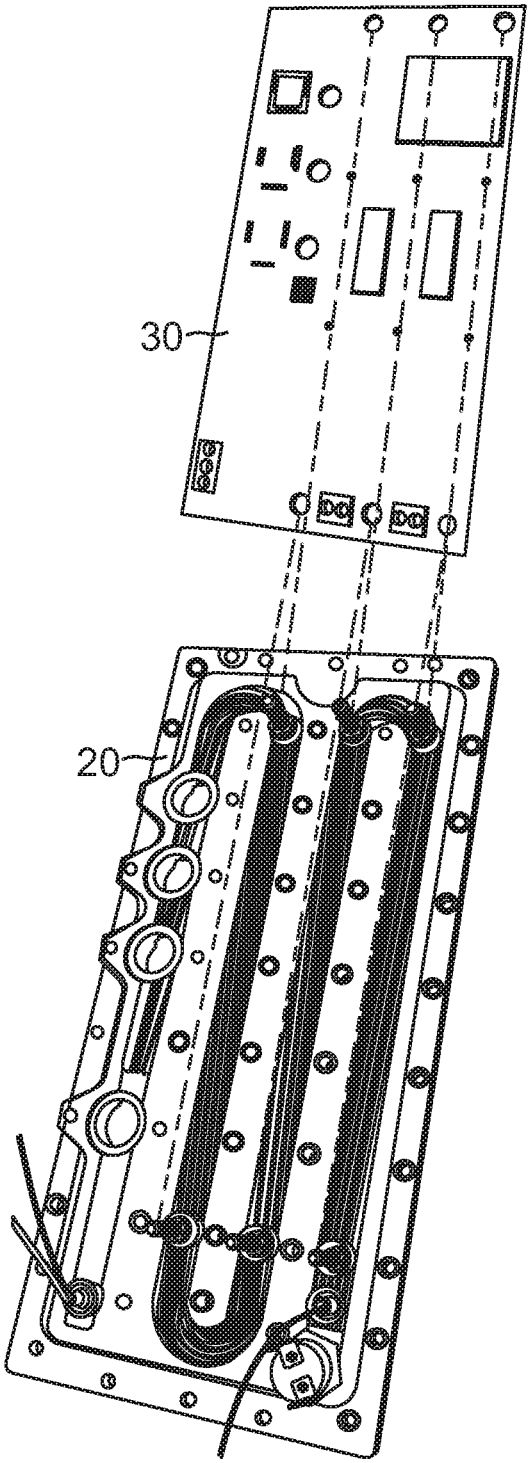
Figure 8C:
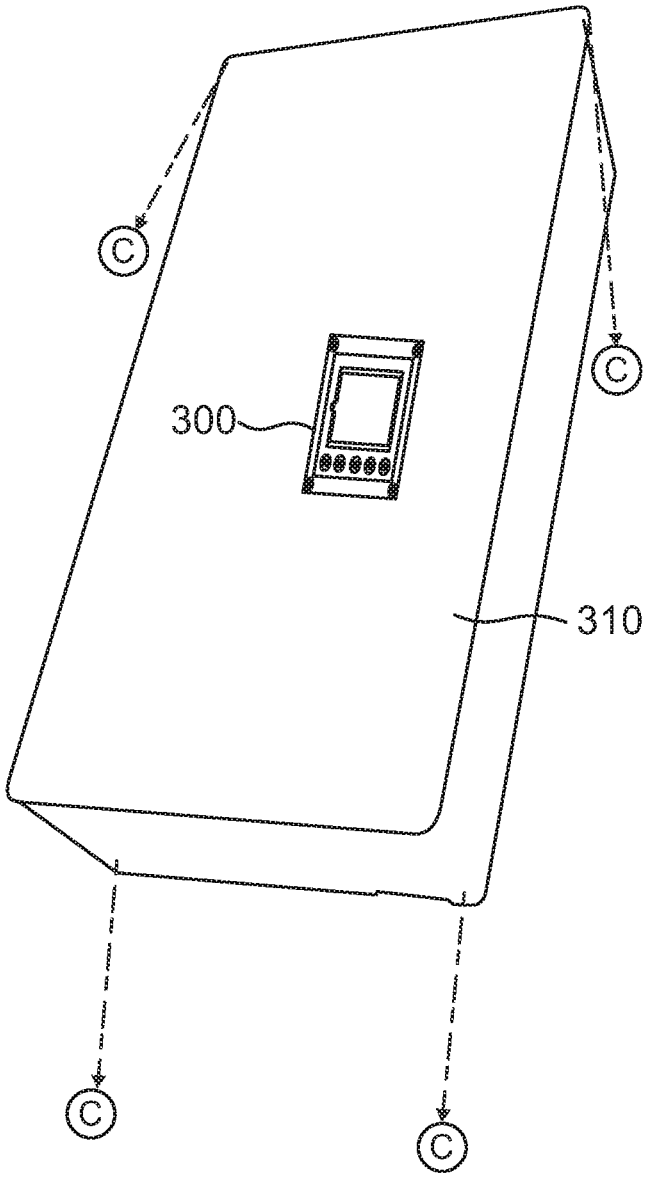

An LCD display 300 is illustrated in FIG. 7 as a feature on the exterior of a cover 310 (see also FIG. 8C). The display 300 may display any of a wide variety of information that may be of interest to a user, technician, or others. For instance, the system and/or display may have multi-color backlighting to enhance viewing and to draw attention to status messaging. Set-Point temperature and actual output temperature may be displayed simultaneously, for example. The display may also display such information as fluid temperature at various locations within the heater, gallons per minute (GPM) of water flow, hours of operation, date, time of day, temperature history, energy use, water used over a chosen period of time, and any other information that may be of interest to a user and/or support professionals.

FIGS. 8A-C illustrate, in exploded view components of the system. In FIG. 8A, the water heater body fits into a metal steel base 130, with inlet and outlet ports extending through openings in the base 130. FIG. 8B illustrates the circuit board 30 fitting atop the water heater body 20. FIG. 8C illustrates the cover 310 with LCD screen 300 on the exterior, fitting over the assembly such that corners C slide down onto location C on the metal base (FIG. 8A).

Considering alternative embodiments, the heater may be used in several configurations. In the first configuration, a single water heater heats an entire house or apartment on demand, without having to store pre-heated water in a tank. In another, two or more units may be interconnected to increase the heating ability. In one embodiment, the heaters are connected with stainless steel flex-hose in a 2, 3, or 4 unit daisy-chain arrangement. In yet another variation, individual heating units may be located near areas where hot water is used, such as adjacent to showers, dishwashers, clothes washers, and the like.

In operation of a preferred embodiment, water flows into the inflow port. The flow sensor detects that water is flowing. A temperature sensor determines the temperature of the water flowing into the water heater. As the water flows, it encounters the molded twisting grooves, which increase the turbulence of the flow. The water then flows across one or more heating coils which, preferably, the water contacts directly. The microprocessor takes input from various sensors to determine how much power to provide to the heating elements. The power may be increased or decreased in order to achieve the desired output temperature, which the user may input. On exit from the heater, a temperature sensor determines the temperature of the exiting water to ensure that the heater is meeting the outflow water temperature target. If the water is too hot or too cold, the microprocessor adjusts power supplied to the heating coils until the water exiting the unit is within a desired temperature range.

As seen in the drawings, the unit may include various other components, such as a relay and power distribution blocks. The unit is typically housed within an enclosure, which may be made of steel or other material.

Specific exemplary embodiments of the present invention may have various features. In one embodiment, a digital control allows a user to select a set-point between 70 F and 140 F, with a factory default setting of approximately 110 F or 120 F. Of course, these settings and ranges may be altered for specific uses.

In a presently preferred embodiment, water will flow regardless of what temperature it has reached. There is no valve in the heater of this embodiment to control flow. The only other "valve" in this example system is a UL Required Pressure Relief Valve that will open at 150 psi, for example, to bleed off pressure. In alternative embodiments, a control valve may be incorporated at a desired location and controlled by a microprocessor based on inputs from sensors.

To sense incoming water flow, a paddle wheel style flowmeter may be placed within 3-4 inches of the water inlet, for example. In one type of flowmeter, a small plastic flapper forces the water across a paddle wheel during very low-flow situations to overcome small flow-rates in which there is not enough water-flow to make the paddle wheel move. Water flow at higher volumes easily moves the paddle wheel, as the plastic flapper moves out of the way. Alternatively, other types of flow sensors that detect flow and/or flow rate may be used.

Although in the preferred embodiment the heater heats water, it may be adapted to heat other fluids. Depending on the fluid, adjustments may need to be made, such as ensuring that the material of the heating element is compatible with the fluid to be heated. The present invention may also be adapted for use in extreme cold or heat environments, underwater, or in other specialized environments. In such cases, the housing in which the heater resides may include insulation or other means to protect the heater from the external conditions, for instance.

As used herein, the term "upper" and "lower" are relative terms. For example, upper and lower portions of the clamshell unit may be side-by-side in some configurations. Consequently, "upper" and "lower" are not directionally limiting.

In view of the many possible embodiments to which the principles of the disclosed invention may be applied, it should be recognized that the illustrated embodiments are only preferred examples of the invention and should not be taken as limiting the scope of the invention. Rather, the scope of the invention is defined by the following claims. We therefore claim as our invention all that comes within the scope and spirit of these claims.

What is claimed is:

1. A tankless hot water heater for heating potable water comprising:

a molded polymer body having an inlet and an outlet that are in fluid communication with one another;

a channel extending from the inlet to the outlet;

at least one heating element extending through at least a portion of the channel and configured to heat water flowing through the channel;

at least one sensor configured to measure temperature of water flowing through the channel prior to coming into contact with the at least one heating element;

at least one sensor configured to measure flow of water flowing through the channel prior to coming into contact with the at least one heating element;

at least one sensor configured to measure temperature of water flowing through the channel after coming into contact with the at least one heating element; and a controller adapted to control heat generated by the at least one heating element based on input from the temperature and flow sensors;

wherein the molded body is a clamshell design having a molded upper portion and a molded lower portion that are separable from one another, with the molded polymer upper and lower portions removably secured together, the channel being molded into at least one of the upper and lower polymer portions to form a molded polymer channel;

the heater element comprises at least one heating coil inside the channel, the coil being in direct contact with water when water flows through the channel;

the channel being deeper at some points than at others; and the at least one heating coil being removably secured within the channel, the heater comprising removable fasteners and the heating coil having first and second ends that are removably secured inside the molded polymer channel with the removable fasteners.

2. The tankless water heater as defined in claim 1, wherein the channel comprises at least two straight portions interconnected by a curved portion, with first and second heating elements extending inside the channel, through first and second straight portions, respectively.

3. The tankless water heater as defined in claim 2, wherein the controller independently controls heat generated by the first and second heating elements.

4. The tankless water heater as defined in claim 1, wherein the channel comprises molded grooves molded inside the water channel adapted to create turbulent flow.

5. The tankless water heater as defined in claim 4, wherein the molded grooves are twisted.

6. The tankless water heater as defined in claim 1, wherein the channel comprises portions having molded grooves and portions that are smooth relative to the portions having grooves.

7. The tankless water heater as defined in claim 1, wherein a portion of the channel is molded into each of the upper and lower portions of the molded body, wherein the channel becomes closed when the upper and lower portions are secured together.

8. The tankless water heater as defined in claim 1, wherein the water heater comprises a display unit for displaying water temperature, heater performance data, heater diagnostic data, and/or user selectable inputs.

9. The tankless water heater as defined in claim 8, wherein the water heater includes an input device for receiving desired temperature settings from a user.

10. The tankless water heater as defined in claim 1, wherein the water heater further comprises a pressure relief valve.

11. The tankless water heater as defined in claim 1, wherein the controller comprises a microprocessor and memory.

12. The tankless water heater as defined in claim 1, wherein the heating element is a coil in direct contact with the water, the coil having first and second ends, wherein the water heater further comprises removable fasteners that removably fasten the first and second ends of the heating coil inside the channel.

13. The tankless water heater as defined in claim 1, wherein the channel comprises a series of generally straight portions interconnected with curved portions, the straight and curved portions being molded into the body.

14. The tankless water heater as defined in claim 1, wherein a plurality of heating elements extend in respective generally straight portions of the channel.

15. The tankless water heater as defined in claim 1, wherein the molded body comprises an injection molded body.

16. The tankless water heater as defined in claim 1, wherein the body comprises a polymer having an operating temperature range suitably high to accommodate a temperature of water it heats.

17. The tankless water heater as defined in claim 1, wherein the flow sensor is a flow rate sensor.

18. A tankless, on-demand hot water heater for potable water comprising:

an injection molded body having a water inlet and a water outlet that are in fluid communication with one another;

a channel extending from the inlet to the outlet, the channel having at least two molded straight portions interconnected by a molded curved portion, with first and second heating elements extending inside the channel through first and second straight portions, respectively, the first and second heating elements adapted to be in direct contact with water when water flows through the channel and being removably secured within the channel;

at least one sensor configured to measure temperature of water flowing through the channel prior to coming into contact with a heating element;

at least one flow sensor configured to sense flow of water flowing through the channel prior to coming into contact with a heating element;

at least one sensor configured to measure temperature of water flowing through the channel after coming into contact with the heating elements; and a controller comprising a microprocessor adapted to control heat generated by the heating elements independently from one another, based on input from the temperature and flow rate sensors;

wherein the molded body is a clamshell design having an upper portion and a lower portion that are separable from one another, with the upper and lower portions removably secured together; and wherein the channels comprise twisted grooves molded into the water channel and adapted to create turbulent flow.

19. The hot water heater as defined in claim 18, wherein the flow sensor is a flow rate sensor.

20. A tankless hot water heater comprising:

a molded body having an inlet and an outlet that are in fluid communication with one another via a channel;

at least one heating element extending through and inside at least a portion of the channel and configured to directly contact and heat water when water is flowing through the channel;

at least one sensor configured to measure at least one of water temperature and a water flow characteristic at a location in the channel; and a controller adapted to control heat generated by the at least one heating element based on input from the at least one sensor;

wherein the molded body has an upper portion and a lower portion, with the channel molded into the upper portion of the molded body and/or molded into the lower portion of the molded body, the upper and lower portions of the body being removably secured together.

* * * * *